US007752735B2

(12) United States Patent
Farmer et al.

(10) Patent No.: US 7,752,735 B2
(45) Date of Patent: Jul. 13, 2010

(54) COIL BUS TRANSFORMER AND A METHOD OF MANUFACTURING THE SAME

(75) Inventors: Randall Farmer, Poca, WV (US); Charlie Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 48 days.

(21) Appl. No.: 12/184,489

(22) Filed: Aug. 1, 2008

(65) Prior Publication Data

US 2009/0039996 A1 Feb. 12, 2009

Related U.S. Application Data

(60) Provisional application No. 60/954,896, filed on Aug. 9, 2007.

(51) Int. Cl.
*H01F 7/06* (2006.01)
*H01F 30/12* (2006.01)
*H01F 27/24* (2006.01)

(52) U.S. Cl. ..... 29/602.1; 336/212; 336/181; 336/182; 336/12

(58) Field of Classification Search ..... 29/602.1
See application file for complete search history.

(56) References Cited

U.S. PATENT DOCUMENTS

| | | | | |
|---|---|---|---|---|
| 3,742,122 | A | 6/1973 | Glavos et al. | |
| 4,042,775 | A | 8/1977 | Lin et al. | |
| 4,163,689 | A | 8/1979 | Grossman et al. | |
| 4,262,413 | A | 4/1981 | Morton | |
| 4,281,306 | A | 7/1981 | Schoendube | |
| 4,326,181 | A | 4/1982 | Allen | |
| 4,359,599 | A | 11/1982 | Benner | |
| 4,372,029 | A | 2/1983 | Morton | |
| 4,536,733 | A * | 8/1985 | Shelly | 336/182 |
| 4,594,295 | A * | 6/1986 | Waasner et al. | 428/581 |
| 5,083,101 | A * | 1/1992 | Frederick | 333/181 |
| 5,168,255 | A * | 12/1992 | Poulsen | 336/5 |
| 5,652,648 | A * | 7/1997 | Behe et al. | 399/164 |
| 2007/0163110 | A1 * | 7/2007 | Sutardja | 29/827 |

FOREIGN PATENT DOCUMENTS

| | | | | |
|---|---|---|---|---|
| DE | 2205072 | | 8/1973 | |
| EP | 0045035 | A1 * | 2/1982 | 29/602.1 |
| JP | 60-241204 | | 11/1985 | |
| WO | PCT/US2008/009343 | | 11/2008 | |

* cited by examiner

*Primary Examiner*—Anh T Mai
(74) *Attorney, Agent, or Firm*—Paul R. Katterle

(57) ABSTRACT

The invention is directed to a transformer and a method of manufacturing the same. The transformer has high and low voltage coils mounted to legs of a core. Each low voltage coil includes conductor sheeting having opposing first and second ends and opposing first and second side edges. A pair of coil bus bars is provided for each low voltage coil. Each coil bus bar has first and second portions, wherein the first portion has a width that is more than one and a half times greater than a width of the second portion. Each coil bus bar is secured to the conductor sheeting of its low voltage coil such that the first portion of the coil bus bar is disposed at the first side edge of the conductor sheeting and the second portion of the coil bus bar is disposed at the second side edge of the conductor sheeting.

17 Claims, 6 Drawing Sheets

COIL BUS TRANSFORMER AND A METHOD OF MANUFACTURING THE SAME

CROSS-REFERENCE TO RELATED APPLICATION

This application claims the benefit of U.S. provisional patent application No. 60/954,896 filed on Aug. 9, 2007, which is hereby incorporated by reference in its entirety.

BACKGROUND OF THE INVENTION

This invention relates to transformers and more particularly to a coil bus for a transformer.

As is well known, a transformer converts electricity at one voltage to electricity at another voltage, either of higher or lower value. A transformer achieves this voltage conversion using a primary coil and a secondary coil, each of which are wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

In the layer winding technique, the conductor turns required for a coil are typically wound in one or more concentric conductor layers connected in series, with the turns of each conductor layer being wound side by side along the axial length of the coil until the conductor layer is full. A layer of insulation material is disposed between each pair of conductor layers.

A different type of layer winding technique is disclosed in U.S. Pat. No. 6,221,297 to Lanoue et al., which is assigned to the assignee of the present application, ABB Inc., and which is hereby incorporated by reference. In the Lanoue et al. '297 patent, alternating sheet conductor layers and sheet insulating layers are continuously wound around a base of a winding mandrel to form a coil. The winding technique of the Lanoue et al. '297 patent can be performed using an automated dispensing machine, which facilitates the production of a layer-wound coil.

In the layer winding technique utilizing sheet conductor layers, the ends of the sheet conductor of the coil are secured to coil bus bars that extend vertically (along the axis of the coil) to a top or a bottom of the coil, depending on the construction of the transformer in which the coil is mounted. The coil bus bars are usually secured to the sheet conductor by welding. Conventionally, the coil bus bars are formed of metal (such as copper or aluminum) and are rectangular in shape. Typically, the two coil bus bars are formed from a single rectangular bar by cutting the bar in half with a cut made perpendicular to the length of the bar.

In order to reduce the cost of a transformer, it is desirable to reduce the amount of metal (particularly copper) that is used in the transformer. The present invention is directed to coil bus bars that utilize less metal than conventional coil bus bars.

SUMMARY OF THE INVENTION

In accordance with the present invention, a method of manufacturing a transformer is provided. In accordance with the method, a conductor sheeting and a coil bus bar are provided. The conductor sheeting has opposing first and second ends and opposing first and second side edges. The coil bus bar has first and second portions. The first portion has a width that is more than one and a half times greater than a width of the second portion. A low voltage coil is formed from the conductor sheeting. The coil bus bar is secured to an end of the conductor sheeting such that the first portion of the coil bus bar is disposed at the first side edge of the conductor sheeting and the second portion of the coil bus bar is disposed at the second side edge of the conductor sheeting.

Also provided in accordance with the present invention is a transformer having a ferromagnetic core with a leg and high and low voltage coils mounted to the leg. The low voltage coil includes a conductor sheeting having opposing first and second ends and opposing first and second side edges. A coil bus bar is provided and includes first and second portions. The first portion has a width that is more than one and a half times greater than a width of the second portion. The coil bus bar is secured to the conductor sheeting of the low voltage coil such that the first portion of the coil bus bar is disposed at the first side edge of the conductor sheeting and the second portion of the coil bus bar is disposed at the second side edge of the conductor sheeting.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
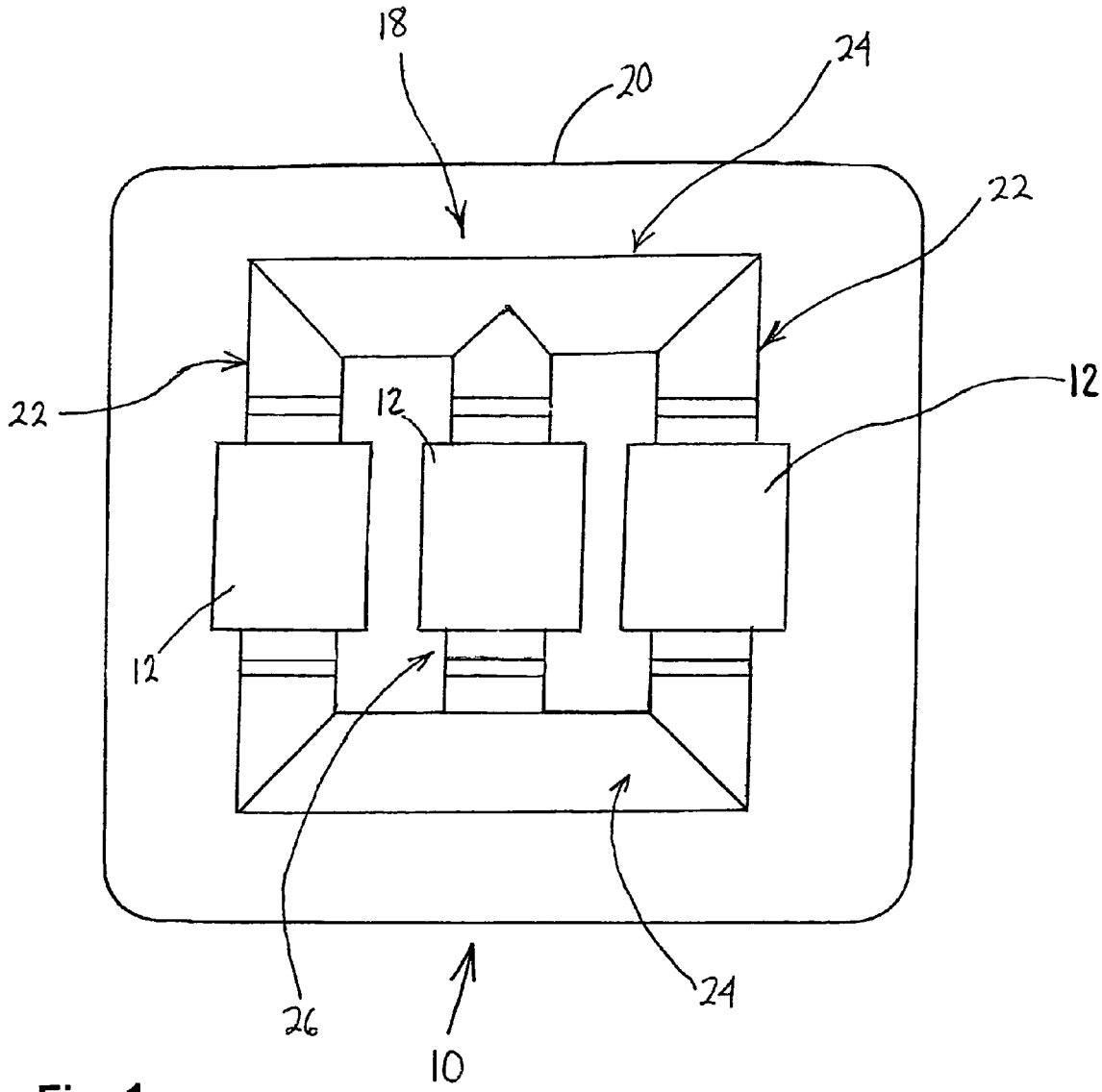
FIG. 1 is a schematic view of a transformer.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somwhat schematic form.

Referring now to FIG. 1, there is shown a schematic sectional view of a three phase transformer 10 containing a coil embodied in accordance with the present invention. The transformer 10 comprises three coil assemblies 12 (one for each phase) mounted to a core 18 and enclosed within an outer housing 20. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The coil assemblies 12 are mounted to and disposed around the outer legs 22 and the inner leg 26, respectively. Each coil assembly 12 comprises a high voltage coil and a low voltage coil 28 (shown in FIG. 2), each of which is cylindrical in shape. If the transformer 10 is a step-down transformer, the high voltage coil is the primary coil and the low voltage coil 28 is the secondary coil. Alternately, if the transformer 10 is a step-up transformer, the high voltage coil is the secondary coil and the low voltage coil 28 is the primary coil. In each coil assembly 12, the high voltage coil and the low voltage coil 28 may be mounted concentrically, with the low voltage coil 28 being disposed within and radially inward from the high voltage coil, as shown in FIG. 1. Alternately, the high voltage coil and the low voltage coil 28 may be mounted so as to be axially separated, with the low voltage coil 28 being mounted above or below the high voltage coil. In accordance with the present invention, each low voltage coil 28 comprises concentric layers of conductor sheeting 40 to which coil bus bars 42 are secured.

The transformer 10 is a distribution transformer and has a kVA rating in a range of from about 112.5 kVA to about 15,000 kVA. The voltage of the high voltage coil is in a range of from about 600 V to about 35 kV and the voltage of the low voltage coil is in a range of from about 120 V to about 15 kV.

Although the transformer 10 is shown and described as being a three phase distribution transformer, it should be appreciated that the present invention is not limited to three phase transformers or distribution transformers. The present invention may utilized in single phase transformers and transformers other than distribution transformers.

Figure 2:
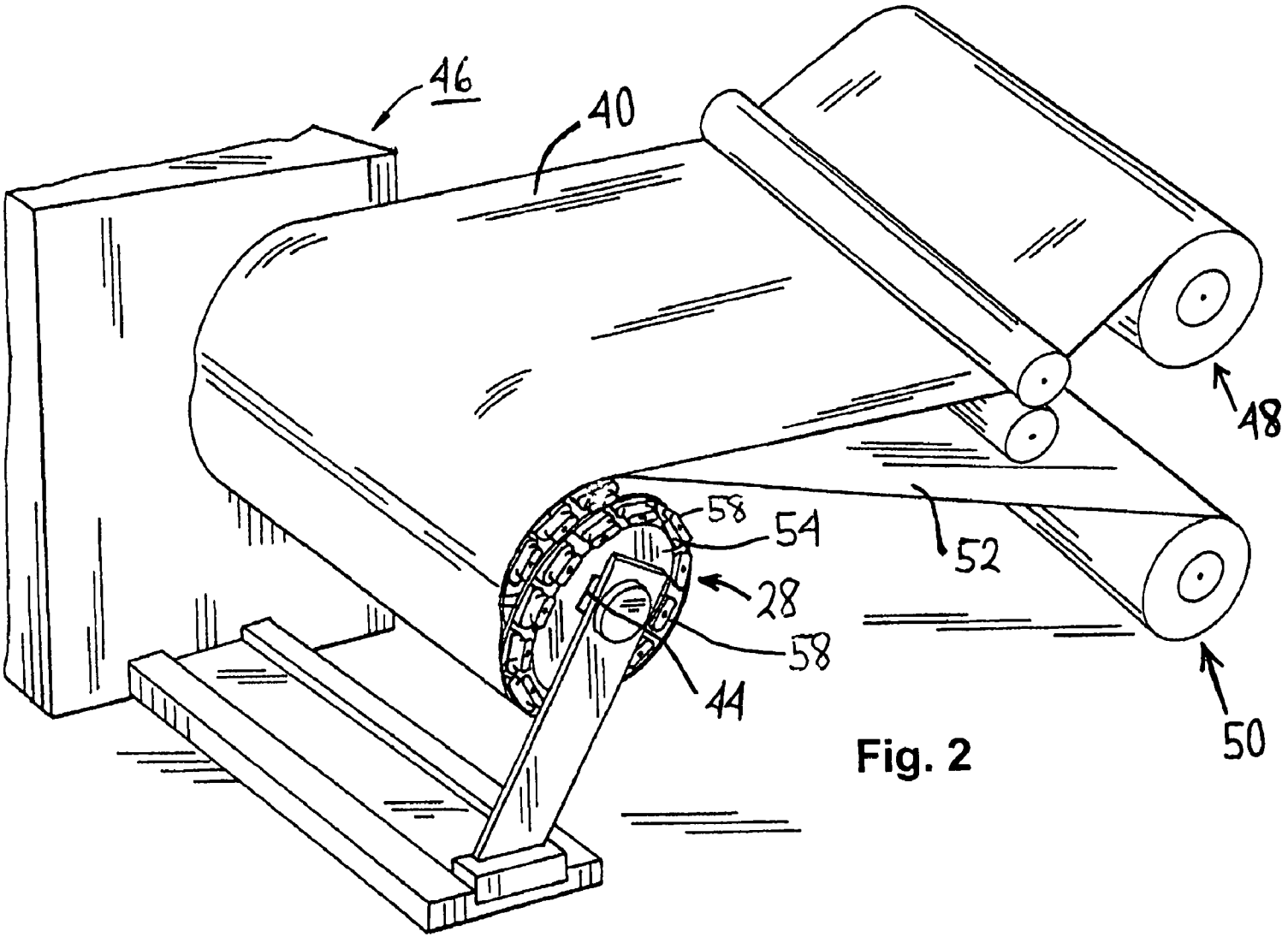
FIG. 2 is a perspective view of a low voltage coil of the transformer being formed from conductor sheeting and insulation sheeting in a winding machine.

Referring now to FIG. 2, one of the low voltage coils 28 is shown being formed on a winding mandrel 44 of a winding machine 46. A roll 48 of the conductor sheeting 40 and a roll 50 of insulator sheeting 52 are disposed adjacent to the winding machine 46. An inner mold 54 composed of sheet metal or other suitable material is mounted on the mandrel 44. The inner mold 54 may first wrapped with an insulation layer comprised of woven glass fiber (not shown). A first or inner end of the conductor sheeting 40 is secured to a first or inner coil bus bar 42*a* (shown in FIG. 3) embodied in accordance with the present invention, as will be described more fully below. The inner end of the conductor sheeting 40 is disposed over and is aligned with a first or inner end of the insulator sheeting 52 and is secured to the inner mold 54. The mandrel 44 is then rotated, thereby causing the conductor sheeting 40 and the insulator sheeting 52 to be dispensed from the rolls 48, 50, respectively, and to be wound around the mandrel 44 to form a plurality concentrically-disposed alternating layers of conductor sheeting 40 and insulator sheeting 52. During this winding process, cooling ducts 58 may be inserted between layers of the conductor sheeting 40. At the conclusion of the winding process, a second or outer coil bus bar 42*b* is secured to a second or outer end of the conductor sheeting 40, as will be described more fully below.

Figure 3:
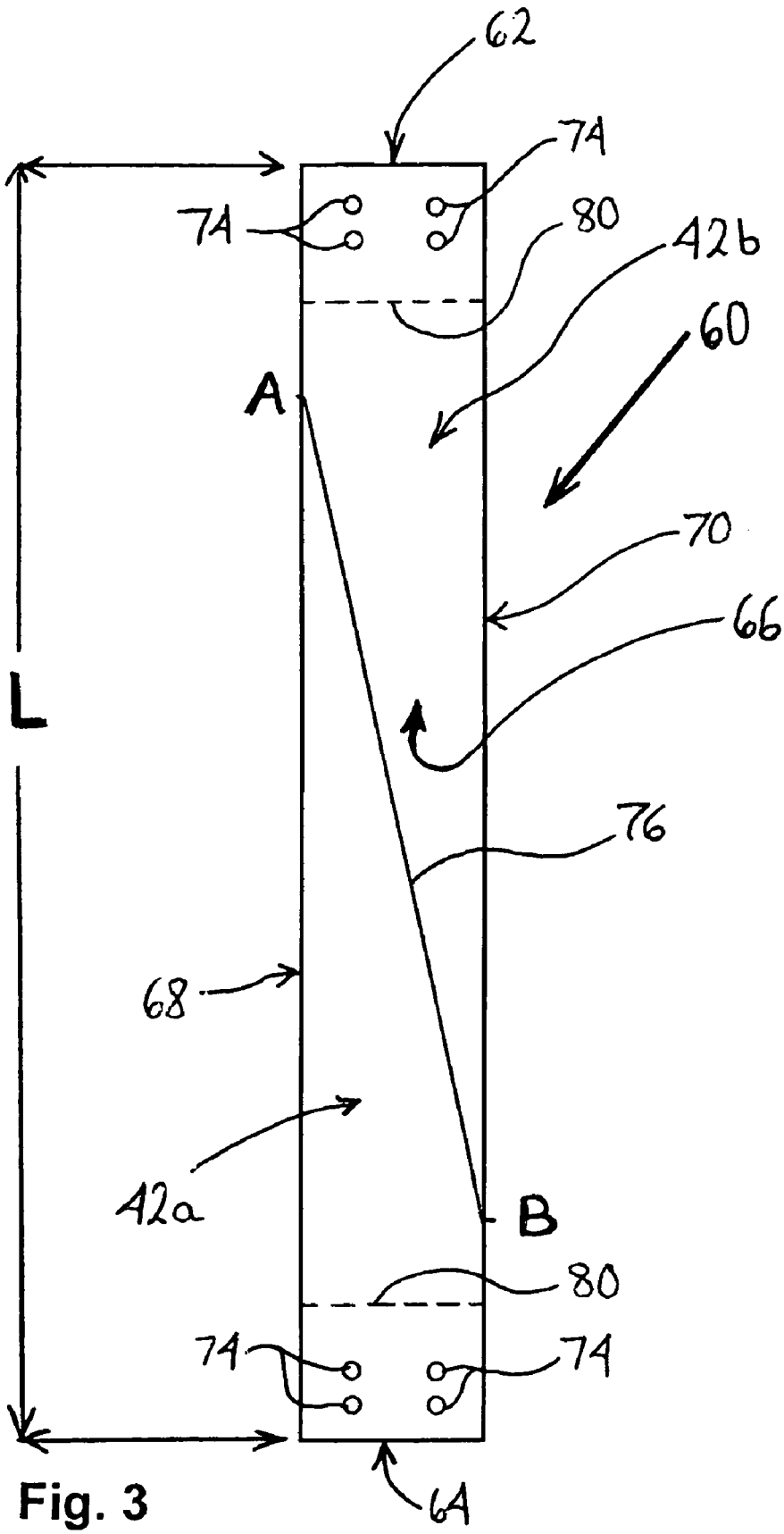
FIG. 3 is a front elevational view of a pair of coil bus bars being formed from a single rectangular bar.
Figure 4:
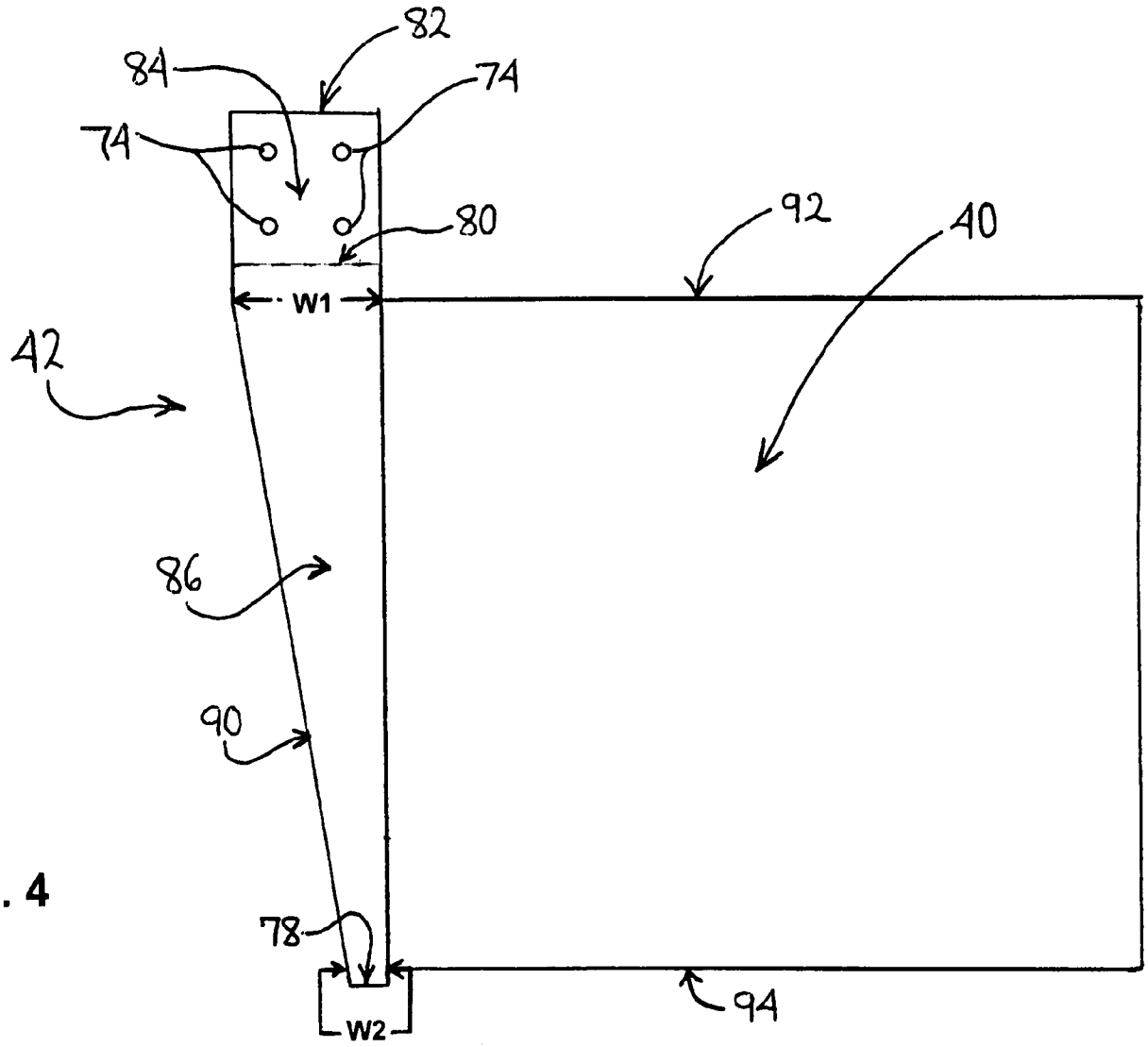
FIG. 4 shows a coil bus bar secured to an end of conductor sheeting of a low voltage coil.
Figure 5:
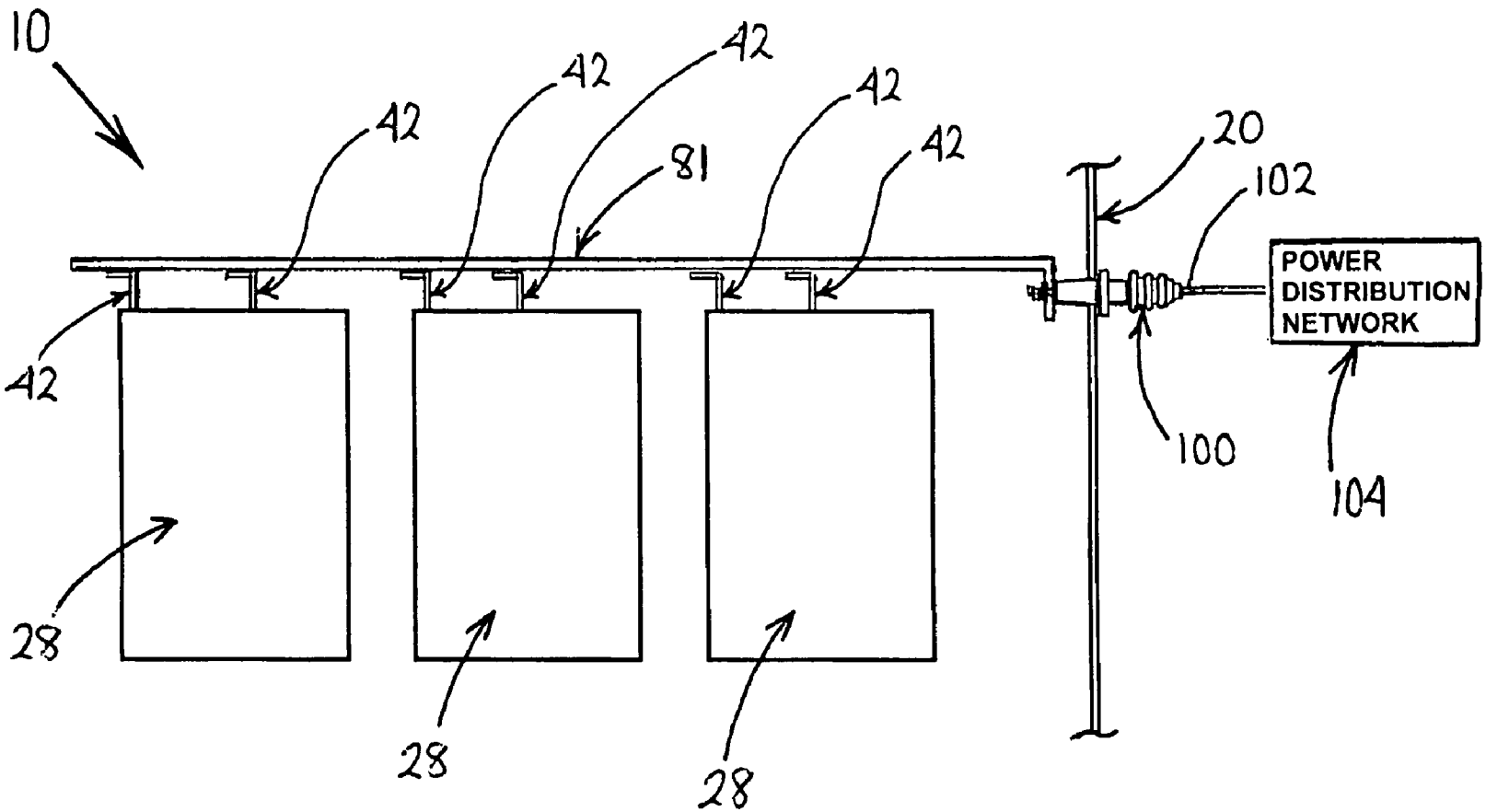
FIG. 5 is a partial schematic view of the transformer showing coil bus bars connecting low voltage coils to low voltage bus bars.

Referring now to FIG. 3, the inner and outer coil bus bars 42*a,b* are formed from a single bar 60, which is composed of a metal such as copper or aluminum and has a rectangular cross-section. The bar 60 has a length "L" and includes opposing first and second ends 62, 64, a first major surface 66 and an opposing second major surface (not shown), and opposing first and second minor surfaces 68, 70. First and second patterns of mounting holes 74 are formed in the bar 60, toward the first and second ends 62, 64, respectively. The mounting holes 74 extend through the first major surface 66 and the second major surface. A diagonal cut 76 is made in the bar 60 to divide the bar 60 into two pieces that form the inner and outer coil bus bars 42*a*, 42*b*, respectively. The cut 76 extends from a point "A" on the first minor surface 68 to a point "B" on the second minor surface 70. Point "A" is located about 20% of the length "L" away from the first end 62 and point "B" is located about 20% of the length "L" away from the second end 64. The cut 76 is made at angle of from about 10° to about 15°, more particularly at about 12° from the first and second minor surfaces 68, 70. After the cut 76 is made, the pointed ends of the two pieces may be cut to form flattened minor ends 78 of the coil bus bars 42, respectively, as shown in FIG. 4. In addition, bends 80 (indicated by dashed lines) may be formed in the coil bus bars 42 to adapt the coil bus bars 42 for connection to low voltage bus bars 81 (as is shown in FIG. 5).

Referring now to FIG. 4, each coil bus bar 42 has the minor end 78 and an opposing major end 82 that corresponds to the first end 62 or the second end 64 of the bar 60. When flat, each coil bus bar 42 is wedge-shaped, having a connection section 84 with the shape of a rectangle and a main section 86 substantially having the shape of a right triangle. The major end 82 is in the connection section 84, while the minor end 78 is in the main section 86. The mounting holes 74 are disposed in the connection section 84, toward the major end 82. The bend 80 is also disposed in the connection section 84 and may form an angle of about 90°. The main section 86 has a sloping surface or edge 90 that extends from the connection section 84 to the minor end 78. The sloping edge 90 corresponds to the cut 76 and, thus, extends from the minor end 78 at an angle of from about 10° to about 15°, more particularly at about 12°.

Each coil bus bar 42 is secured to an end of the conductor sheeting 40 such that a first portion of the coil bus bar 42 is disposed at a first side edge 92 of the conductor sheeting 40 and a second portion of the coil bus bar 42 is disposed at a second side edge 94 of the conductor sheeting 40. The first portion of the coil bus bar 42 is disposed at the juncture of the connection section 84 and the main section 86 and has a width W1 that is same as the width of the connection section 84. The second portion of the coil bus bar 42 is disposed toward the minor end 78 and has a width W2. The width W1 is greater than the width W2. More specifically, the width W1 is more than one and a half times, more particularly, more than two times, still more particularly, more than three times greater than the width W2.

The coil bus bars 42 are secured to the ends of the conductor sheeting 40 by welding. Various welding techniques may be utilized, such as tungsten inert gas (TIG) welding, metal inert gas (MIG) welding, or cold welding. TIG welding, also known as gas tungsten arc welding (GTAW) is an arc welding process that uses a nonconsumable tungsten electrode to produce a weld. MIG welding, also known as gas metal arc welding (GMAW), is a semi-automatic or automatic arc welding process in which a continuous and consumable wire electrode and a shielding gas are fed through a welding gun to form a weld. Cold welding is a pressure welding process which produces a molecular bond through the flow of metals under extremely high pressures. Cold welding is typically performed without the application of heat. However, to augment a weld, heat may be applied. In addition, cold welding may be performed in a vacuum.

Referring now to FIG. 5, the coil bus bars 42 are shown connecting the low voltage bus bars 81 to the low voltage coils 28. The low voltage bars 81, in turn, are connected to bushings 100 that extend through the outer housing 20 of the transformer 10. Leads 102 of the bushings 100 are adapted for connection to an external power distribution circuit 104. Each coil bus bar 42 may be connected to a low voltage bus bar 81 by bolts (not shown) that extend through the voltage bus bar 81 and the mounting holes 74 in the connection section 84 of the coil bus bar 42. As shown in FIG. 5, the coil bus bars 42 extend parallel to the longitudinal axes of the low voltage coils 28 and the connection sections 84 of the coil bus bars 42 are disposed above the low voltage coils 28.

Figure 6:
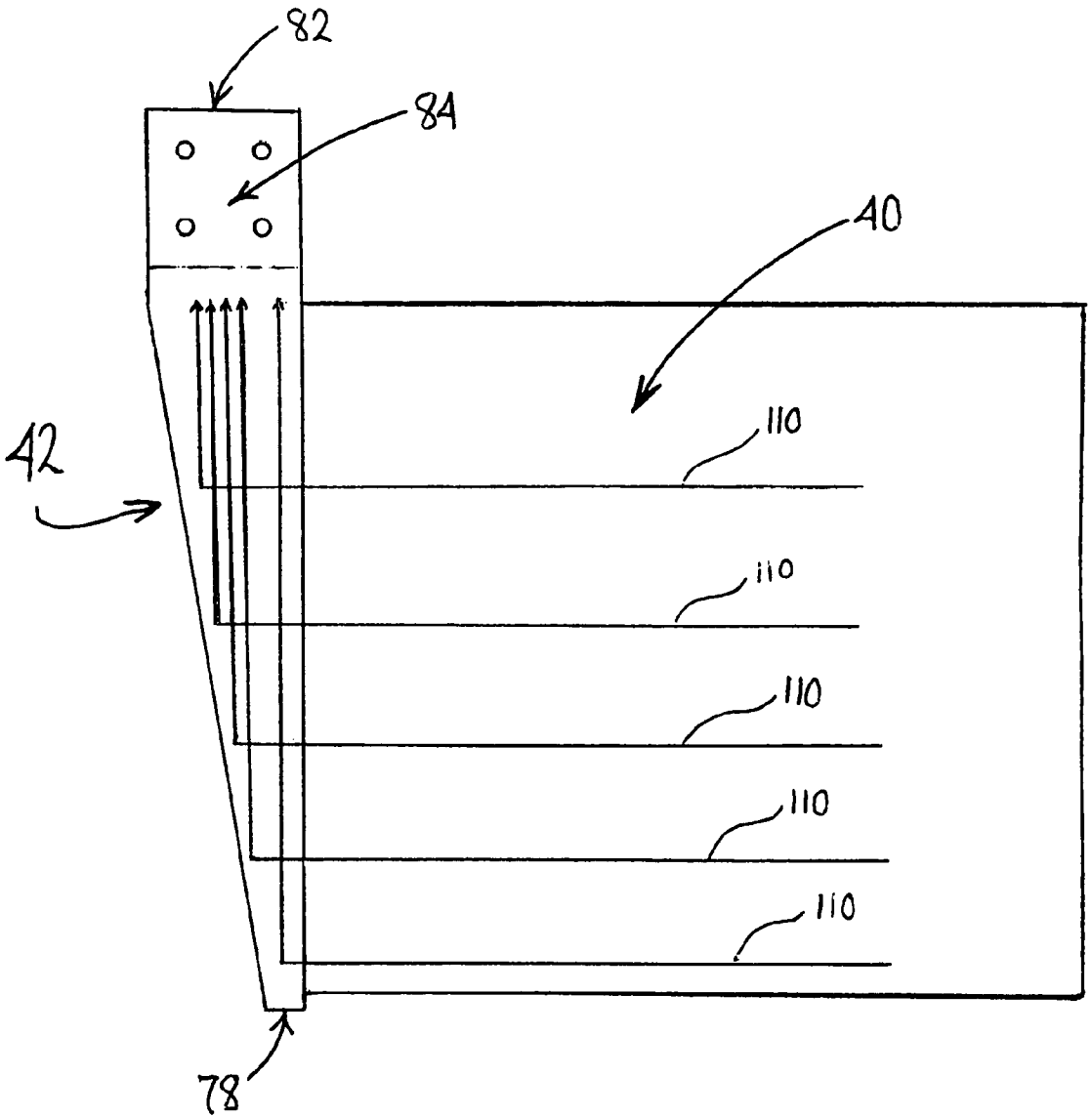
FIG. 6 schematically shows current flowing through conductor sheeting of a low voltage coil and into a coil bus bar.

Without being limited by any particular theory, the operation of the coil bus bars 42 will be described with reference to FIG. 6. When power is provided to the high voltage coils of the transformer 10, current flows horizontally through the conductor sheeting 40 in the low voltage coils 28. As this current flow (indicated by the arrows 110) transitions to the coil bus bars 42, the current flow makes a 90° turn to flow vertically through the coil bus bars 42. In this transition, the lower part of each coil bus bar 42 (i.e., toward the minor end 78) carries only about half of the current load carried by the top part of the coil bus bar 42 (i.e., toward the major end 82). For this reason, less conductor mass is required in the lower part of the coil bus bar 42 than in the upper part of the coil bus bar 42. Accordingly, each coil bus bar 42 can have the construction shown and described above, i.e., wide toward the end connected to the power distribution circuit and narrow toward the opposing end.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of manufacturing a transformer comprising:

(a.) providing conductor sheeting having opposing first and second ends and opposing first and second side edges;

(b.) providing a coil bus bar having first and second portions and a main section, the first portion having a width that is more than one and a half times greater than a width of the second portion, the main section having first and second longitudinal edges extending between the first and second portions, the first and second longitudinal edges being non-parallel;

(c.) forming a low voltage coil from the conductor sheeting; and (d.) securing the coil bus bar to an end of the conductor sheeting such that: the first portion of the coil bus bar is disposed at the first side edge of the conductor sheeting, the second portion of the coil bus bar is disposed at the second side edge of the conductor sheeting, the first longitudinal edge of the coil bus bar extends perpendicularly between the first and second side edges of the conductor sheeting, and the second longitudinal edge of the coil bus bar faces away from the end of the conductor sheeting.

2. The method of claim 1, further comprising providing a mandrel and wherein the step of forming the low voltage coil comprises winding the conductor sheeting on the mandrel.

3. The method of claim 2, further comprising providing an insulating sheeting, and wherein the step of forming the low voltage coil comprises winding the insulating sheeting on the mandrel at the same time the conductor sheeting is wound on the mandrel, whereby the low voltage coil comprises alternating layers of the conductor sheeting and the insulating sheeting.

4. The method of claim 1, wherein the coil bus bar is secured to the conductor sheeting before the low voltage coil is formed.

5. The method of claim 1, wherein the coil bus bar is secured to the conductor sheeting by welding.

6. The method of claim 1, wherein the coil bus bar is a first coil bus bar and wherein the method further comprises providing a second coil bus bar that also comprises first and second portions and a main section, the first portion having a width that is more than one and a half times greater than a width of the second portion, the main section having first and second side edges extending between the first and second portions, the first and second side edges being non-parallel.

7. The method of claim 6, wherein the first and second coil bus bars are each comprised of copper.

8. The method of claim 6, wherein in each of the first and second coil bus bars, the main section has substantially the shape of a right triangle.

9. The method of claim 8, wherein the steps of providing the first and second coil bus bars comprises providing a rectangular bar and making a diagonal cut between opposing sides of the rectangular bar to separate the rectangular bar into two pieces from which the first and second coil bus bars are formed, respectively, each of the pieces comprising the main section and a rectangular connection section.

10. The method of claim 9, wherein the steps of providing the first and second coil bus bars further comprises making about a 90° bend in the connection section of each of the first and second coil bus bars.

11. The method of claim 1, further comprising:

providing a low voltage bus bar;

providing a high voltage coil;

providing a ferromagnetic core with a leg;

providing a housing with a bushing extending therethrough;

mounting the high and low voltage coils to the leg of the core;

disposing the core and the high and low voltage coils in the housing;

connecting the low voltage bus bar between the coil bus bar and the bushing.

12. The method of claim 11, wherein the step of connecting the low voltage bus bar comprises connecting the low voltage bus bar to a connection section of the coil bus bar using bolts, and wherein the first portion of the coil bus bar is disposed at the juncture between the connection section and the main section.

13. The method of claim 1, wherein the width of the first portion of the coil bus bar is more than three times greater than the width of the second portion of the coil bus bar.

14. The method of claim 1, wherein the coil bus bar further comprises major and minor ends and a connection section having mounting holes formed therein, wherein the first portion of the coil bus bar is disposed at the juncture between the connection section and the main section, and wherein the main section comprises the second portion.

15. The method of claim 14, wherein the connection section comprises the major end and the second portion is disposed proximate to the minor end.

16. The method of claim 15, wherein the connection section is rectangular and the main section is triangular.

17. The method of claim 15, wherein the main section comprises the minor end.

* * * * *